US005671861A

United States Patent [19]

Hall et al.

[11] Patent Number: 5,671,861

[45] Date of Patent: Sep. 30, 1997

[54] HOLDER FOR SUPPORTING PLASTIC BAGS

[76] Inventors: Kenneth A. Hall, 9421 Harvard St. #2, Bellflower, Calif. 90706; John R. Fischer, 314 Randall Ave., Freeport, N.Y. 11520

[21] Appl. No.: 615,504

[22] Filed: Mar. 12, 1996

[51] Int. Cl.[6] ..... B65D 90/04

[52] U.S. Cl. ..... 220/404; 220/909

[58] Field of Search ..... 220/404, 909, 220/908; 248/97

[56] References Cited

U.S. PATENT DOCUMENTS

| | | | |
|---|---|---|---|
| 3,752,494 | 8/1973 | Dunn | 220/404 |
| 3,757,990 | 9/1973 | Buth | 220/404 |
| 4,925,056 | 5/1990 | McCoig | 220/404 |
| 4,955,496 | 9/1990 | Nelson | 220/404 |
| 5,054,724 | 10/1991 | Hutcheson | 220/404 |
| 5,150,809 | 9/1992 | Leigh | 220/404 |
| 5,183,174 | 2/1993 | Quintero | 220/404 |
| 5,190,183 | 3/1993 | McNaughton et al. | 220/404 |
| 5,222,704 | 6/1993 | Light | 220/404 |
| 5,535,914 | 7/1996 | Badalamenti et al. | 220/404 |

*Primary Examiner*—Joseph M. Moy

*Attorney, Agent, or Firm*—Timothy T. Tyson; Ted Masters

[57] ABSTRACT

A holder 20 for supporting loop-handled plastic bags 500 includes a support structure 22, two oppositely positioned cleats 28 and 30 for accepting the loop handles 506, and at least two oppositely positioned downwardly projecting fingers 36 and 40 for downwardly engaging the side portions 508 and 510 of the plastic bags 500 and thereby holding the plastic bags 500 in an open state suitable for receiving deposited items. In a preferred embodiment, cleats 28 and 30 and downwardly projecting fingers 36 and 40 are permanently connected to the mouth 26 of a wastebasket-type container 22. In an alternative embodiment, cleats 128 and 130 and downwardly projecting fingers 136 and 140 are removably connected to container mouth 126 with clips 129 and 150, and are selectively positionable along the mouth 126.

14 Claims, 4 Drawing Sheets

Fig. 1
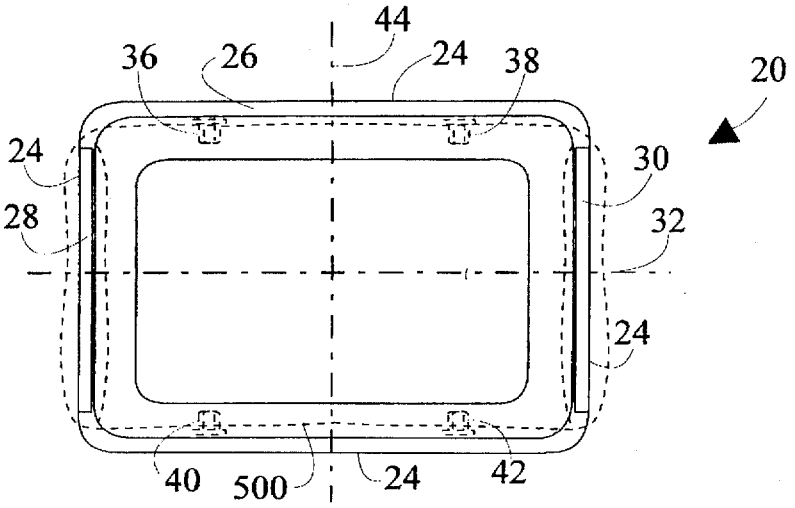
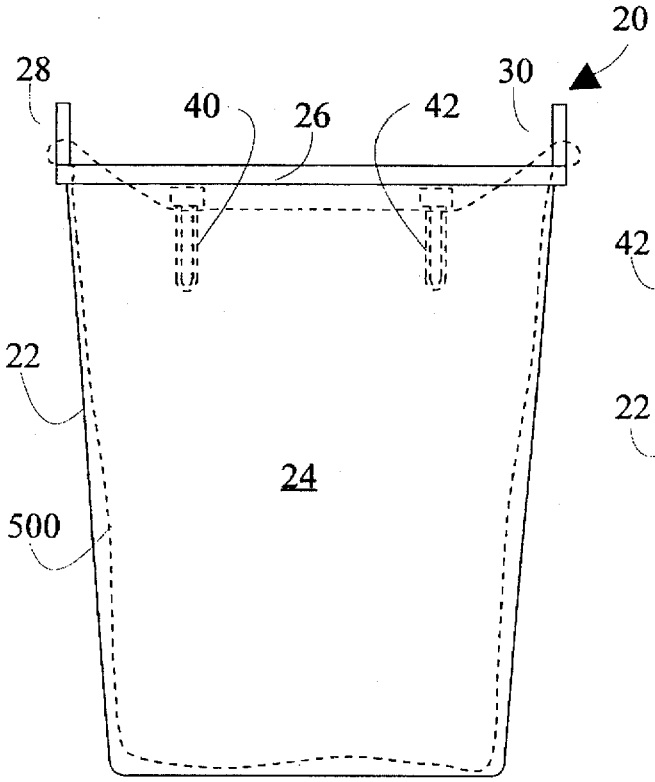
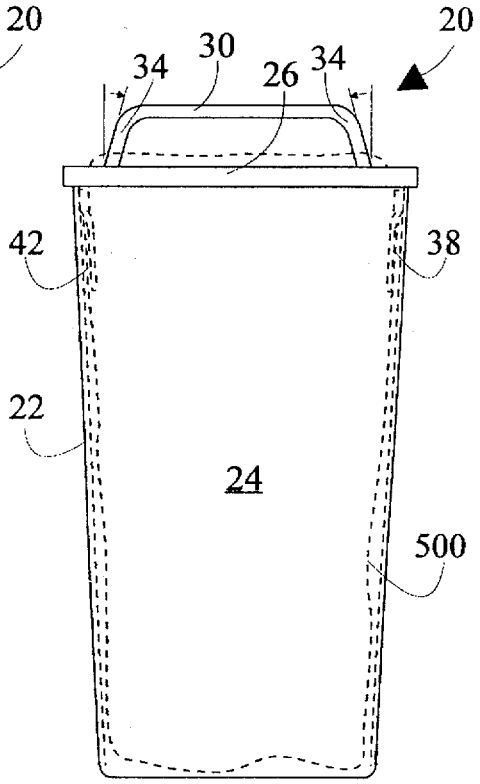
Fig. 2
Fig. 3

Fig. 7
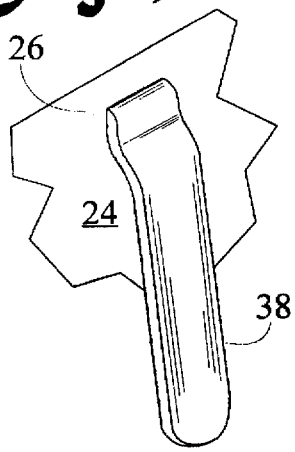
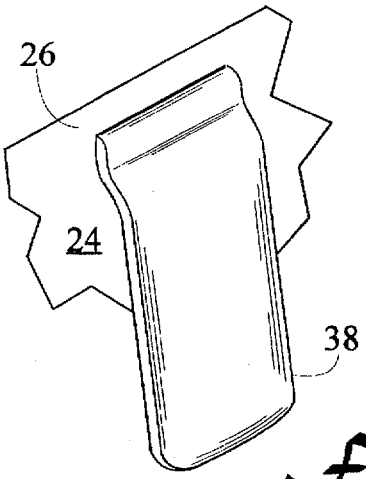
Fig. 8
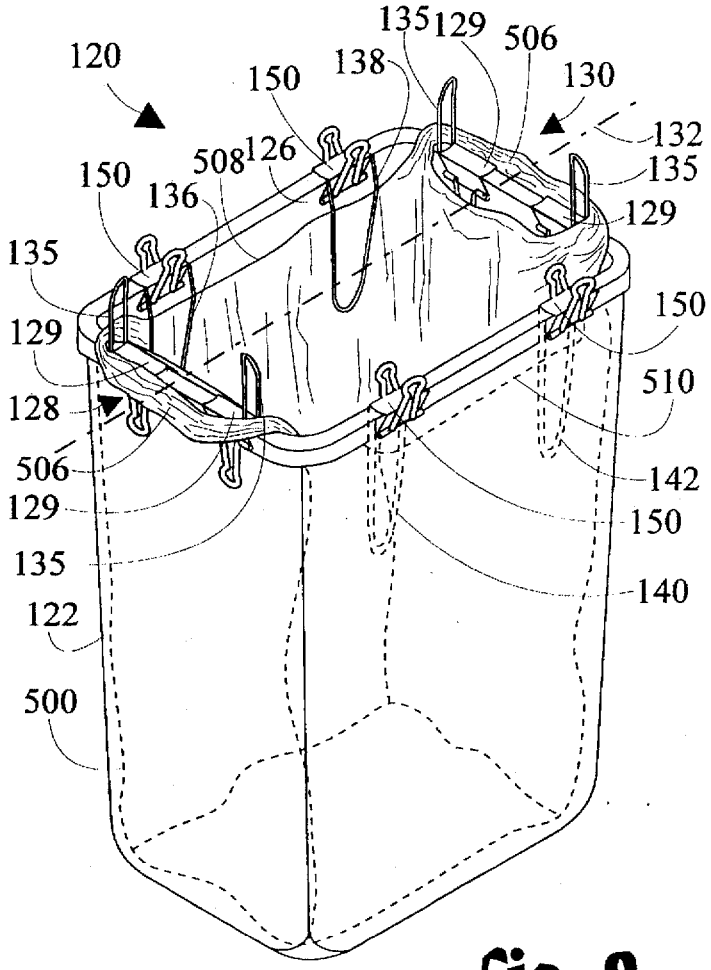
Fig. 9
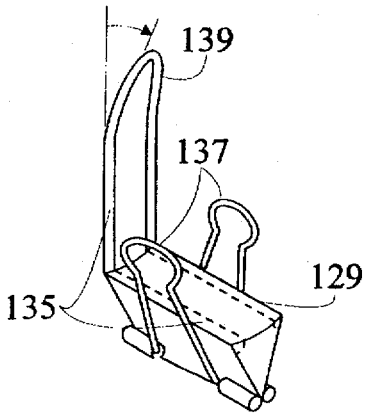
Fig. 10
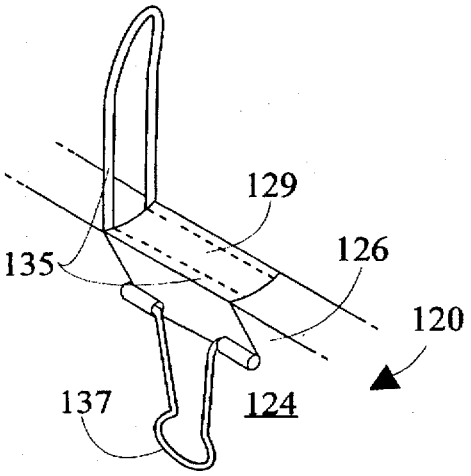
Fig. 11

HOLDER FOR SUPPORTING PLASTIC BAGS

TECHNICAL FIELD

The present invention pertains to holders such as wastebaskets or other containers which hold plastic bags in an open state so that items may be deposited in the bags.

BACKGROUND ART

Devices which accept plastic bag liners are well known in the art. These devices typically comprise a container such as a wastebasket into which the plastic bag liner is installed. The container and associated liner are then filled with the desired items. When the container and liner are full, the liner and its contents are removed and a new liner is installed. For example, U.S. Pat. No. 3,825,150 shows a molded waste receptacle having liner bag holders. The holders consist of resilient tabs formed in the side walls of the receptacle which are adapted to be sprung inwardly by pressing on their exterior surfaces for engaging and pinching the bag. U.S. Pat. No. 4,338,979 defines a bag holding device including a box-like structure having a corner defining a notch. After a bag is placed in the structure and overlaps the periphery of the structure's mouth, an elastic band encircles the outside of the structure, resides in the notch, and holds the bag in place. U.S. Pat. No. 4,437,634 depicts a plastic sack holder which holds a handled limp plastic sack. A pair of spaced apart protuberances are affixed to the outer side of the holder and engage and retain the handles of the sack. U.S. Pat. No. 4,623,111 disclosed a wire holder for handled open mouth plastic bags. The holder has tabs integrally formed from the top wire pieces which extend downwardly to suspend the bags in an open position. U.S. Patent comprises a trash/garbage container with external liner retainers. Four ears, one at each corner, support a bag liner with minimal interference during filling and removal. U.S. Pat. No. 4,951,831 consists of an ecologist flexible public trash bag receptacle. A plurality of slots are molded into the lower circumference of the receptacle which create flexible side panels which bulge outwardly as trash is compacted into the plastic trash receptacle liner. U.S. Pat. No. 5,054,724 describes a container for supporting a handled limp plastic bag in an upright, four cornered configuration. Horizontal support members are inserted into the internal pleats of a bag's handle. U.S. Pat. No. 5,100,087 includes a fastening device for container liners. A vertical row of fastening devices are located on the external surface of the container. The fastening devices fix one handle of the plastic bag to the side of the container such that the mouth of the bag is pulled tight against the opposite side of the container.

DISCLOSURE OF INVENTION

The present invention is directed to a holder for supporting loop-handled plastic bags in an open state so that items may be deposited in the bags, such as for the purpose of collecting trash or other articles. In a preferred embodiment the plastic bags are those commonly utilized by grocery stores to package purchases, the bags having two integral loop carrying handles, and two side portions disposed between the handles. The holder has opposing cleats which accept the loop handles, and perpendicularly oriented opposing downwardly projecting fingers which engage the side portions.

The holder can accommodate a plurality of plastic bags in layered relationship. Therefore, when the top bag is full, it may be removed and a new bag is immediately available.

Also, when a bag is full, more than one bag may be removed to carry the collected contents. This is particularly useful for heavy or wet loads. And, unlike other bag or liner holders, the bag is not folded over the mouth of the holder. Therefore, the full storage capacity of the bag may be realized.

In accordance with a preferred embodiment of the invention, the holder includes a support structure such as a container having an upwardly opening mouth. Two contrapositioned cleats are connected to the mouth and accept the loop handles. At least two contrapositioned downwardly projecting fingers are also connected to the mouth and downwardly engage the side portions thereby holding the plastic bag in an open state.

In accordance with an important feature of the invention, the cleats are handle-shaped and sized to be grasped by a human hand for transporting the holder.

In accordance with an important aspect of the invention, the mouth of the holder may be of different shapes such as, rectangular, square, and elliptical.

In accordance with another feature of the invention, the size of the holder can be selected to accommodate a plurality of different size plastic bags.

In accordance with another aspect of the invention, the end portions of the cleats are sloped to facilitate the installation and removal of the bags.

In accordance with another preferred embodiment of the invention, the cleats and downwardly projecting fingers are connected to clips that are selectively positionable along the mouth of the container.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 1 is a top view of the holder in accordance with the present invention;

FIG. 2 is a side view of the holder;

FIG. 3 is an end view of the holder:

FIG. 7 is an enlarged perspective view of a third embodiment of the downwardly projecting finger;

FIG. 8 is an enlarged perspective view of a fourth embodiment of the downwardly projecting finger;

FIG. 9 is a perspective view of a second holder embodiment;

FIG. 10 is an enlarged perspective view of a second embodiment of the loop handle engaging cleat;

FIG. 11 is an enlarged perspective of a clip installed on the holder;

MODES FOR CARRYING OUT THE INVENTION

Figure 4:
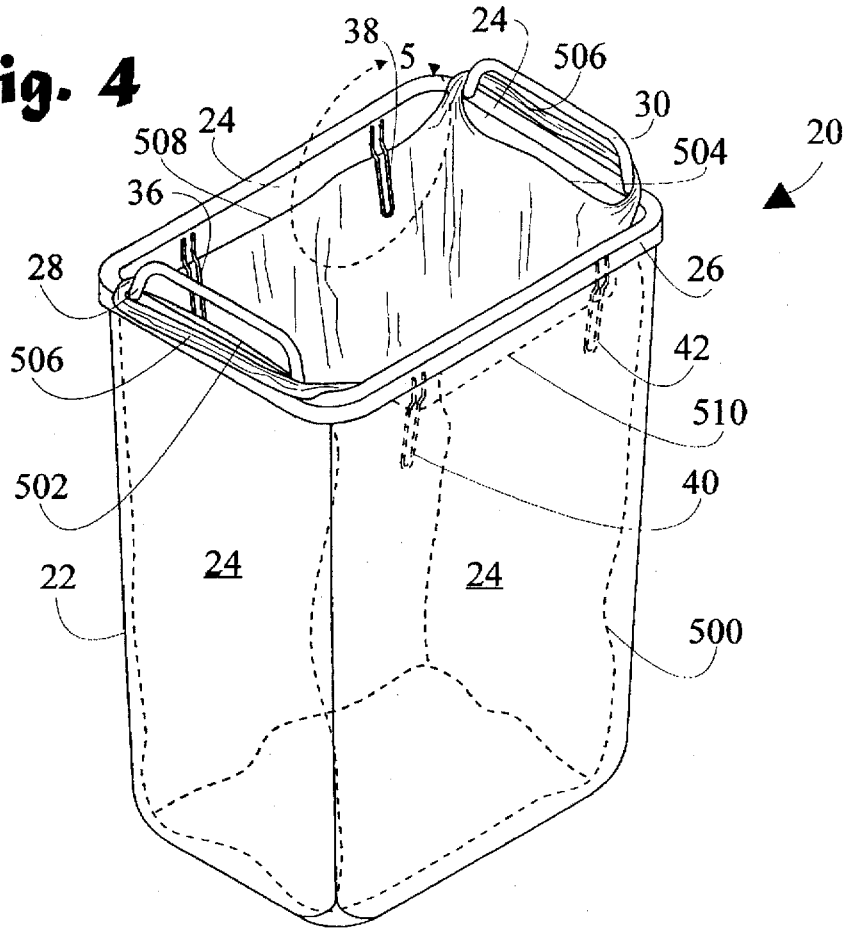
FIG. 4 is a perspective view of the holder showing a plastic bag installed.

Referring initially to FIGS. 1, 2, 3, and 4, there are illustrated top, side, end, and perspective views of a holder for supporting plastic bags in an open state in accordance with the present invention, generally designated as 20. FIG. 4 shows that the plastic bag 500 has two opposite end portions 502 and 504 each having integral loop handles 506, and two opposite side portions 508 and 510 disposed between the end portions 502 and 504. In a preferred embodiment, the plastic bag 500 is of the type utilized by grocery stores to package purchased products.

Holder 20 includes a support structure 22. In the embodiment shown support structure 22 is a wastebasket-shaped container having four connected walls 24 defining an upwardly opening mouth 26. As shown, mouth 26 is substantially rectangular, however it may be appreciated that mouth 26 could have other shapes such as substantially square or substantially elliptical. In another possible embodiment, support structure 22 does not have solid walls 24, but rather could comprise a frame having one or more open sides.

Two contrapositioned cleats 28 and 30 are connected to opposite sides of mouth 26 of support structure 22, and define a first axis 32 therebetween. Cleats 28 and 30 accept loop handles 506 of plastic bag 500 wherein one loop handle 506 is wrapped over and around cleat 28, and the other loop handle 506 is wrapped over and around opposite cleat 30. In the embodiment shown, cleats 28 and 30 are handle-shaped and sized to be grasped by a human hand for conveniently transporting holder 20. In FIG. 3 it is noted that the end portions 34 of cleats 28 and 30 are sloped to facilitate the installation and removal of handles 506 of plastic bag 500.

Contrapositioned downwardly projecting fingers 36, 38, 40, and 42 are connected to mouth 26 of support structure 22 for downwardly engaging the side portions 508 and 510 and thereby holding plastic bag 500 in an open state. The downwardly projecting fingers overlap side portions 508 and 510, resulting in the side portions being captively held between the downwardly projecting fingers and walls 24. In the embodiment shown, two spaced downwardly projecting fingers 36 and 38 are disposed on one side of mouth 26, and two other spaced downwardly projecting fingers 40 and 42 are disposed on the opposite side of mouth 26. Downwardly projecting fingers 36, 38, 40, and 42 are disposed on the inside surface of support structure (container) 22. One downwardly projecting finger on each side of the mouth 26 could also be employed, however the two spaced fingers better urge plastic bag 500 into a wall-hugging position. The oppositely positioned pairs of downwardly projecting fingers 36 and 38, and 40 and 42, define a second axis 44 therebetween. Axis 44 is substantially perpendicular to first axis 32. That is, the cleats 28 and 30 are oriented approximately 90° from the pairs of downwardly projecting fingers 36 and 38, and 40 and 42.

While not specifically illustrated in the figures, it may be readily appreciated that a lid or cover could be added to holder 20, as is the case for many conventional wastebasket-type containers.

Figure 5:
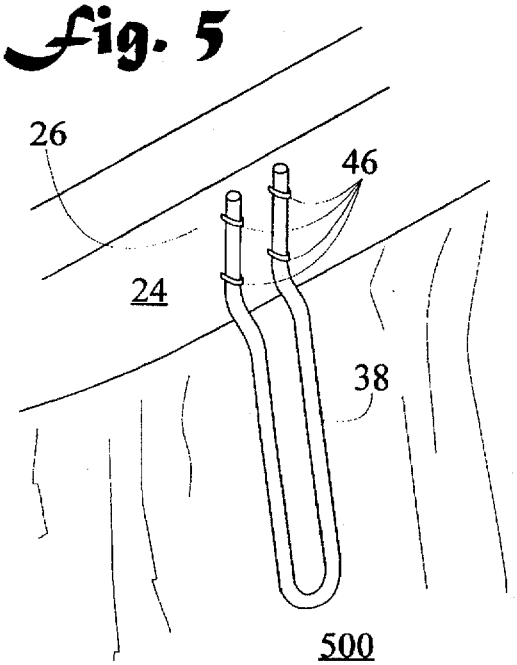
FIG. 5 is an enlarged perspective view of the area designated -5- of FIG. 4, showing a downwardly projecting finger.

FIG. 5 is an enlarged perspective view of the area designated -5- of FIG. 4, showing one downwardly projecting finger 38. Downwardly projecting finger 38 is fabricated from metal or other ridged material, is connected to wall 24 (refer to FIG. 4) by retaining straps 46, and is angled slightly out from wall 24 to facilitate placing and capturing side portion 508 between finger 38 and wall 24.

Figure 6:
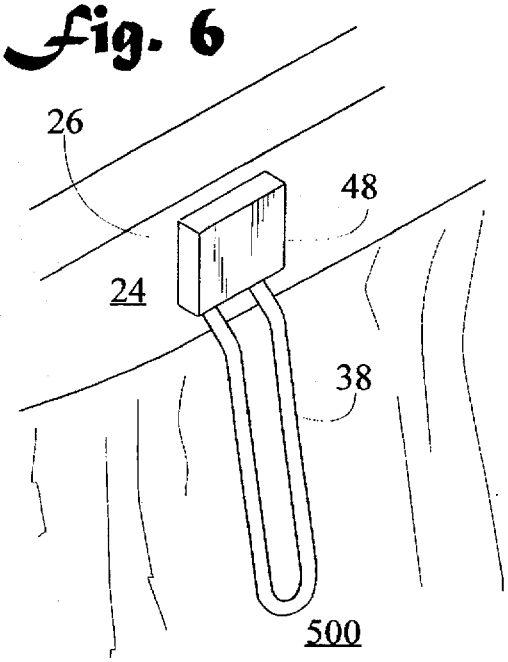
FIG. 6 is an enlarged perspective view of a second embodiment of the downwardly projecting finger.

FIG. 6 is an enlarged perspective view of a second embodiment of downwardly projecting finger 38. In this embodiment finger 38 is attached to a mounting pad 48 which can be either connected to or integral with wall 24.

FIG. 7 is an enlarged perspective view of a third embodiment of downwardly projecting finger 38. In this embodiment finger 38 is a molded part of wall 24.

FIG. 8 is an enlarged perspective view of a fourth embodiment of downwardly projecting finger 38. In this embodiment finger 38 is widened and therefore contacts a greater portion of side portion 508 (refer to FIG. 4).

Holder 20 is used to create a depository for items, such as trash, as follows: Side portion 508 of thin plastic bag 500 is placed under downwardly projecting fingers 36 and 38 and is retained in place between the fingers and wall 24. Side portion 510 of thin plastic bag 500 is placed under downwardly projecting fingers 40 and 42 and is retained in place between the fingers and opposite wall 24. One loop handle 506 is wrapped over and around cleat 28, and the other loop handle 506 is wrapped over and around cleat 30. The plastic bag 500 is thereby held in an open state by the two cleats 28 and 30, and the four downwardly projecting fingers 36, 38, 40, and 42.

When holder 20 and associated plastic bag 500 are full, the bag may be removed by reversing the installation process as follows: Unwrapping one loop handle 506 from cleat 28. Unwrapping the other loop handle 506 from cleat 30. Disengaging side portion 508 from downwardly projecting fingers 36 and 38. Disengaging side portion 510 from downwardly projecting fingers 40 and 42.

In a preferred embodiment a plurality of plastic bags 500 are placed on holder 20 in layered relationship. In this fashion, it is possible to store 12 or more bags simultaneously on holder 20. This multiple bag feature offers several novel advantages. First the total bag installation process is expedited by placing several bags on holder 20 in "assembly-line" fashion. Second, when one bag is full, it may be removed and a new bag is immediately available. Third, several bags can be stored on holder 20, rather than requiring another storage location. And finally, when a bag is full, more than one bag may be removed to carry the contents. This is particularly useful for heavy or wet loads.

FIG. 9 is a perspective view of a second holder embodiment, generally designated 120. In this embodiment, the cleats and downwardly projecting fingers are removably connected to mouth 126 of support structure 122. Therefore, the principles of the present invention may be practiced on any existing container having a size compatible with the plastic bag 500. Cleats 128 and 130 are comprised of spaced apart clips 129 which are removably connected to mouth 126. In a preferred embodiment, clips 129 are modified versions of binder-clips which are available from ACCO USA, Inc. 770 S. Acco Plaza, Wheeling, Ill. 60090-6070. It may be appreciated however, that numerous other forms of clips or clamps could also be utilized, so long as they can be removably attached to mouth 126. Clips 129 each have a protruding member 135 for engaging the loop handle 506 of the plastic bag 500. In a preferred embodiment, protruding member 135 is oriented substantially vertical, and has and end portion which is angled inwardly toward first axis 132 so as to facilitate the installation and removal of loop handles 506 of plastic bag 500. Clips 129 may be selectively spaced along one side of mouth 126 to best accommodate the size and shape of loop handle 506. Two tabs 137 are manually pinched together to open clips 129 for engaging mouth 126. As shown, clips 129 have their tabs 137 (refer to FIGS. 10 and 11) rotated to a downward position so as not to interfere with loop handles 506 as they are wrapped over and around cleats 128 and 130. The downward position of clips 137 is also useful if a cover is to be attached to holder 120.

Again referring to FIG. 9, downwardly projecting fingers 136, 138, 140, and 142 are each connected to a different clip 150. Clips 150 are the same basic clip as clip 129. Clip 150 has been modified to include downwardly projecting fingers 136, 138, 140, and 142. Clips 150 are removably connected to mouth 126, and may be selectively spaced along mouth 126 to best accommodate side portions 508 and 510, and urge plastic bag 500 into a wall-hugging position.

Clips 150 are shown with their tabs 137 (refer to FIGS. 12 and 13) in the upward position after installation and positioning on holder 120. In a preferred embodiment, tabs 137 are subsequently rotated to a downward position as is shown in FIG. 13.

FIG. 10 is an enlarged perspective view of clip 129 having protruding member 135 with end portion 139. In a preferred embodiment, protruding member 135 is fabricated from wire which has been welded, braised, or soldered to clip 129. Two tabs 137 are used to open clip 129 for attachment to holder 120. Alternatively, protruding member 135 and clip 129 could be fabricated as a single integral assembly.

FIG. 11 is an enlarged perspective view of clip 129 installed on the holder 120. Tabs 137 have been rotated to a downward position along wall 124.

Figure 12:
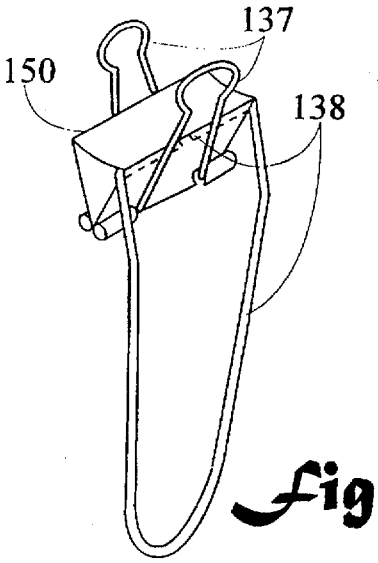
FIG. 12 is an enlarged perspective view of a fifth embodiment of the downwardly projecting finger.
Figure 13:
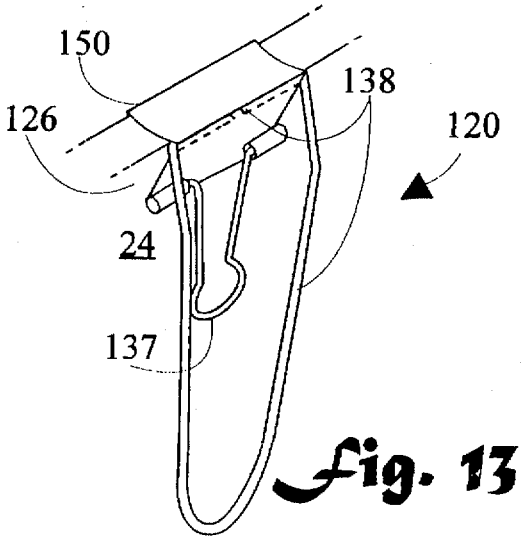
FIG. 13 is an enlarged perspective view of a second type clip installed on the holder.

FIG. 12 is an enlarged perspective view of clip 150 having downwardly projecting finger 138. In a preferred embodiment, downwardly projecting finger 138 is fabricated from wire which has been welded, braised, or soldered to clip 150. Two tabs 137 are used to manually open clip 150 for attachment to holder 120. Alternatively, downwardly projecting finger 138 and clip 150 could be fabricated as a single integral assembly.

FIG. 13 is an enlarged perspective view of clip 150 installed on the holder 120. Tabs 137 have been rotated to a downward position along wall 124.

Holder 120 is used to create a depository for items, such as trash, as follows: Attaching two clips 129 and associated protruding members 135 to one side of mouth 126 forming a first cleat 128. Attaching two other clips 129 and associated protruding members 135 to the opposite side of mouth 126 forming a second cleat 130. Attaching at least one clip 150 and associated downwardly projecting finger 138 to mouth 126 between cleats 128 and 130. Attaching at least one other clip 150 and associated downwardly projecting finger 140 to the opposite side of mouth 126 from downwardly clip 150 and associated downwardly projecting finger 138. Placing side portion 508 under downwardly projecting finger 138. Placing the side portion 510 under downwardly projecting finger 140. Wrapping one of the loop handles 506 over and around said first cleat 128. Wrapping the other loop handle 506 over and around second cleat 130.

Figure 14:
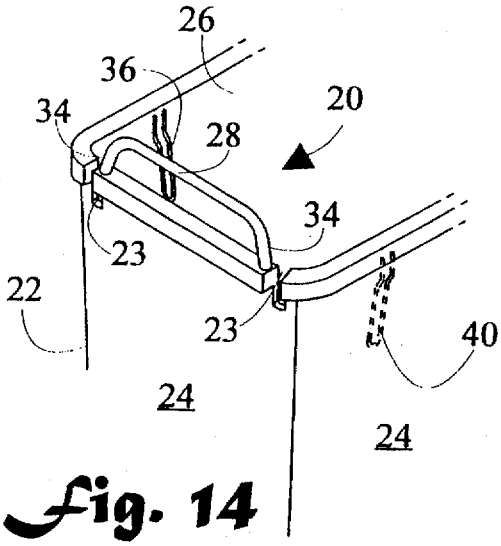
FIG. 14 is a perspective view of a holder having loop handle-receiving slots.

FIG. 14 is a perspective view of a holder 20 having two downwardly projecting loop handle-receiving slots 23 disposed adjacent to cleat 28 (and also to cleat 30, refer to FIG. 4). Slots 23 are located adjacent to end portions 34, and project downwardly a predetermined distance into wall 24. Slots 23 can accept and retain a greater number of bag loop handles 506 which could not otherwise be accommodated by cleat 28.

Figure 15:
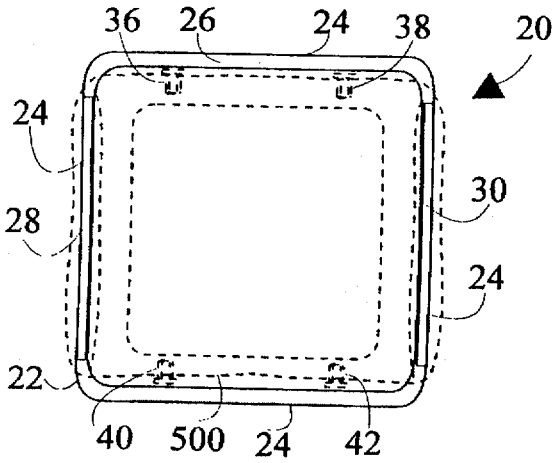
FIG. 15 is a top view of a holder having a square mouth.

FIG. 15 is a top view of a holder 20 having a substantially square mouth 26. The holder 20 is comprised of container 22, cleats 28 and 30, downwardly projecting fingers 36, 38, 40, and 42, and four walls 24.

Figure 16:
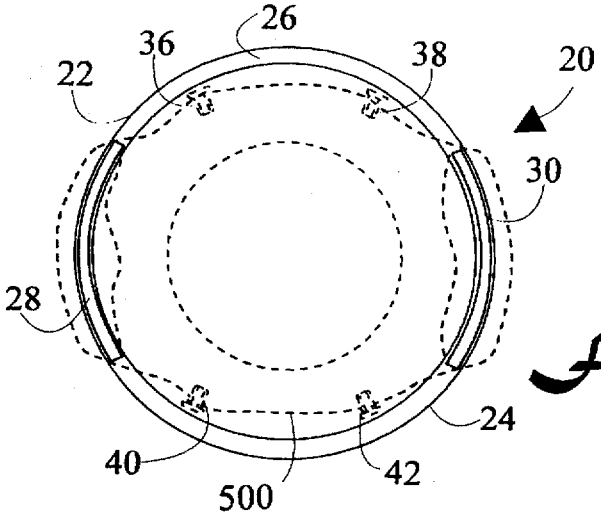
FIG. 16 is a top view of a holder having an elliptical mouth.

FIG. 16 is a top view of a holder 20 having a substantially elliptical mouth 26. In the shown embodiment, the mouth is circular which is a special form of an ellipse. The holder 20 is comprised of container 22, cleats 28 and 30, downwardly projecting fingers 36, 38, 40, and 42, and elliptical wall 24.

While in a preferred embodiment, holders 20 and 120 are sized to accommodate the plastic bags 500 utilized by grocery stores, it may be readily appreciated that the teachings of the present invention could also be practiced on any handled bag such as (1) the smaller bags utilized by drug stores, (2) the larger bags utilized by department stores, or (3) upon large specially designed bags for commercial use. In these instances, the dimensions of holder 20 would be adjusted to accommodate the desired bag.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A holder for supporting a plastic bag in an open state so that items may be deposited in the bag, the plastic bag having two opposite end portions each having an integral loop handle, and two opposite side portions disposed between the end portions, said holder comprising:

a support structure;

two contrapositioned cleats connected to said support structure for accepting the loop handles;

at least two contrapositioned downwardly projecting fingers connected to said support structure for downwardly engaging the side portions and thereby holding the plastic bag in an open state; and, said support structure having walls having an inside surface;

said downwardly projecting fingers disposed on said inside surface of said support structure, said downwardly projecting fingers angled slightly out from said walls to facilitate placing and capturing the side portions between said downwardly projecting fingers and said walls.

2. The holder according to claim 1, said support structure further comprising a container having walls defining an upwardly opening mouth, said two cleats connected to opposite sides of said mouth and defining a first axis therebetween, said downwardly projecting fingers connected to opposite sides of said mouth and defining a second axis therebetween, said first axis substantially perpendicular to said second axis.

3. The holder according to claim 2, wherein said two cleats are handle-shaped and sized to be grasped by a human hand.

4. The holder according to claim 2, said cleats having sloped end portions.

5. The holder according to claim 2, wherein said container has four connected walls and said mouth is substantially rectangular.

6. The holder according to claim 2, wherein said container has four connected walls and said mouth is substantially square.

7. The holder according to claim 2, wherein said container and said mouth are substantially elliptical.

8. The holder according to claim 2, wherein each said cleat comprises spaced clips removably connected to said mouth, said clips each having a protruding member for engaging the loop handle of the plastic bag.

9. The holder according to claim 8, wherein said protruding member is substantially vertical and having an end portion angled inwardly toward said first axis.

10. The holder according to claim 2, wherein two spaced downwardly projecting fingers are disposed opposite to two other spaced downwardly projecting fingers.

11. The holder according to claim 10, wherein said spaced downwardly projecting fingers are each connected to clips, said clips removably connected to said mouth.

12. The holder according to claim 2, wherein said holder is sized to accommodate one of a plurality of different size plastic bags.

13. The holder according to claim 2, further including two downwardly projecting loop handle-receiving slots disposed adjacent to each of said cleats.

14. The holder according to claim 1, further comprising:

said support structure further including a container having walls defining an upwardly opening mouth, said two cleats connected to opposite sides of said mouth and defining a first axis therebetween, said at least two downwardly projecting fingers comprising two pairs of two each spaced downwardly projecting fingers, said pairs connected to opposite sides of said mouth and defining a second axis therebetween, said first axis substantially perpendicular to said second axis;

said two cleats being handle-shaped and sized to be grasped by a human hand;

said container having four connected walls and said mouth being substantially rectangular; and, said downwardly projecting fingers engaging and overlapping the side portions and thereby holding the plastic bag in an open state.

* * * * *